US005241559A

United States Patent [19]

Hixenbaugh

[11] Patent Number: 5,241,559

[45] Date of Patent: Aug. 31, 1993

[54] ELECTRIC ARC FURNACE ROOF

[75] Inventor: Dennis L. Hixenbaugh, Pittsburgh, Pa.

[73] Assignee: EMC International, Inc., Pittsburgh, Pa.

[21] Appl. No.: 859,826

[22] Filed: Mar. 30, 1992

[51] Int. Cl.[5] ..... F27D 1/12

[52] U.S. Cl. ..... 373/74; 373/71; 373/73; 373/76; 373/77; 432/238

[58] Field of Search ..... 373/73, 74, 75, 76, 373/77, 78, 71, 72; 432/237, 238

[56] References Cited

U.S. PATENT DOCUMENTS

| | | | |
|---|---|---|---|
| 2,222,004 | 11/1940 | Smith | 373/73 |
| 4,021,603 | 5/1977 | Nanjyo et al. | 373/73 |
| 4,273,949 | 6/1981 | Fischer et al. | 373/73 |
| 4,345,332 | 8/1982 | Wronka | 373/74 |
| 4,371,970 | 2/1983 | Guilpain et al. | 373/74 |
| 4,417,343 | 11/1983 | Yamamoto | 373/73 |
| 4,425,656 | 1/1984 | Kuhlmann | 373/74 |
| 4,445,220 | 4/1984 | Kuhlmann | 373/74 |
| 4,453,253 | 6/1984 | Lauria et al. | 373/74 |
| 4,553,245 | 11/1985 | Kerr | 373/74 |
| 4,715,042 | 12/1987 | Heggart et al. | 373/74 |

*Primary Examiner*—Bruce A. Reynolds
*Assistant Examiner*—Tu Hoang
*Attorney, Agent, or Firm*—Michael, Best & Friedrich

[57] ABSTRACT

An electric arc furnace has a dished hearth, vertical side walls, and a relatively flat roof consisting of a center portion, a relatively planar outer portion and a cylindrical skirt which abuts the side wall to define a space above and around the expected surface of the furnace charge wherein CO containing waste gases can be oxidized to minimize CO and promote heat transfer to the furnace charge. The roof center portion is refractory having holes for receiving electrodes and the outer portion is formed of water-cooled pipes which define sections of the annulus. The upper end of the side walls is also formed of water-cooled panels.

3 Claims, 2 Drawing Sheets 42
45
44
16
48
25
17
34
26
29
31
33
32
27
28
47

24
48
36
26
28
27
34
16
25
40
10
23
35
20
22
14
21
17
13
12
49
18
19

ELECTRIC ARC FURNACE ROOF

BACKGROUND OF THE INVENTION

This invention relates to electric arc furnaces.

Electric arc furnaces commonly include a hearth, generally vertical side walls and a roof. One or more electrodes extend through suitable openings in the roof for heating the charge contained within the furnace.

Electric furnace steelmaking normally involves the melting of a scrap metal charge which substantially fills the furnace. After charging has been completed, the furnace electrodes are lowered into close proximity with the top of the scrap charge and an arc is struck. Initially, the heat from the arc is directed mainly toward the furnace roof. To minimize roof damage, power is normally maintained at a low level until the electrodes bore into the scrap. At this point, operation is switched to the highest power level for the fastest possible scrap melting. The electrodes melt the scrap charge directly beneath their lower ends and around their outer peripheries as a pool of molten metal collects in the hearth. Upon the formation of the molten metal pool, the charge is melted by the heat from the arc, by the resistance of the current flowing through the charge, and by heat radiated from the molten metal pool and from the electrode. The final process stage is called the "flat bath" condition, which commences when the furnace charge has been entirely melted.

Electric arc furnaces are normally configured to provide an enclosed vessel for containing the materials to be melted and a roof for process containment and thermal efficiency. Originally, arc furnace side walls and roofs were constructed of a refractory material. Also, roofs were formed as an arch so as to be self-supporting. With such refractory lined furnaces, the transition between the second and third melting phases had to be closely controlled to minimize refractory damage which occurs when the furnace lining is exposed to relatively long arcs for a protracted period of time. In order to increase furnace life and enhance efficiency, modern electric arc furnaces normally include water-cooled side walls and roofs.

During a normal scrap melting procedure, the oxidation of carbon, silicon, phosphorus and manganese occur in varying degrees. As a result, clean air regulations require that the furnace be ventilated and that resulting hot gases, dust and fumes be filtered before discharge into the atmosphere. In addition, such regulations place limits on carbon monoxide and nitrogen oxide emissions.

The arched or sloping roof and cylindrical side walls of prior art electric arc furnaces defined a space which conformed roughly with the angle of repose of the scrap and other furnace charge. As a result, such furnaces were not conducive to heat transfer between waste gases and the furnace charge or the oxidation of waste gases passing upwardly from the charge. As a result, relatively large capacity gas cleaning and filtering systems were required.

SUMMARY OF THE INVENTION

It is an object of the invention to provide a new and improved electric arc furnace.

Another object of the invention is to provide an electric arc furnace which is configured to permit combustion and hot gas expansion above the furnace charge.

A further object of the invention is to provide an electric arc furnace in which there is a reduction in the volume of polluting gases that must be cleaned.

A still further object of the invention is to provide an electric arc furnace which is more efficient.

Yet another object of the invention is to provide an electric arc furnace roof configuration which provides improved flow coupling between the roof discharge vent and other openings in the furnace roof.

Still another object of the invention is to provide an electric arc furnace wherein a stable reaction temperature can be maintained for reducing CO levels by minimizing $CO_2$ and $H_2O$ dissociation.

Another object of the invention is to provide an electric arc furnace having a configuration wherein the transfer of heat from waste gases to the furnace charge is promoted.

A further object of the invention is to provide an electric arc furnace wherein electrodes operate at a cooler temperature.

Another object of the invention is to provide an electric arc furnace wherein charging times are reduced.

These and other objects and advantages of the present invention will become more apparent from the detailed description thereof taken with the accompanying drawings.

A still further object of the invention is to provide an electric arc furnace which reduces the loss of fluxing and metallurgical materials to the gas cleaning system.

Yet another object of the invention is to provide an electric arc furnace wherein the formation of NOx is reduced.

In general terms, the invention comprises an electric arc furnace including a hearth for receiving a solid furnace charge and for containing molten metal resulting from the melting of the charge, a side wall extending upwardly from the hearth, a roof extending over the side wall and abutting the upper end of the side wall, and at least one opening in the roof for receiving an electrode therethrough. The furnace is configured such that a solid furnace charge will normally form a mound having a peak and sloping downwardly and outwardly therefrom. The roof has a central portion disposed generally above the peak and is configured so that it is divergent relative to the sloping surface of the mound as the roof and mound extend outwardly toward the side walls to define a space above and around the upper surface of the mound for promoting oxidation of CO and the transfer of heat to the furnace charge from waste gases and the combustion of CO in the space.

DETAILED DESCRIPTION OF THE PREFERRED EMBODIMENT

Figure 2:
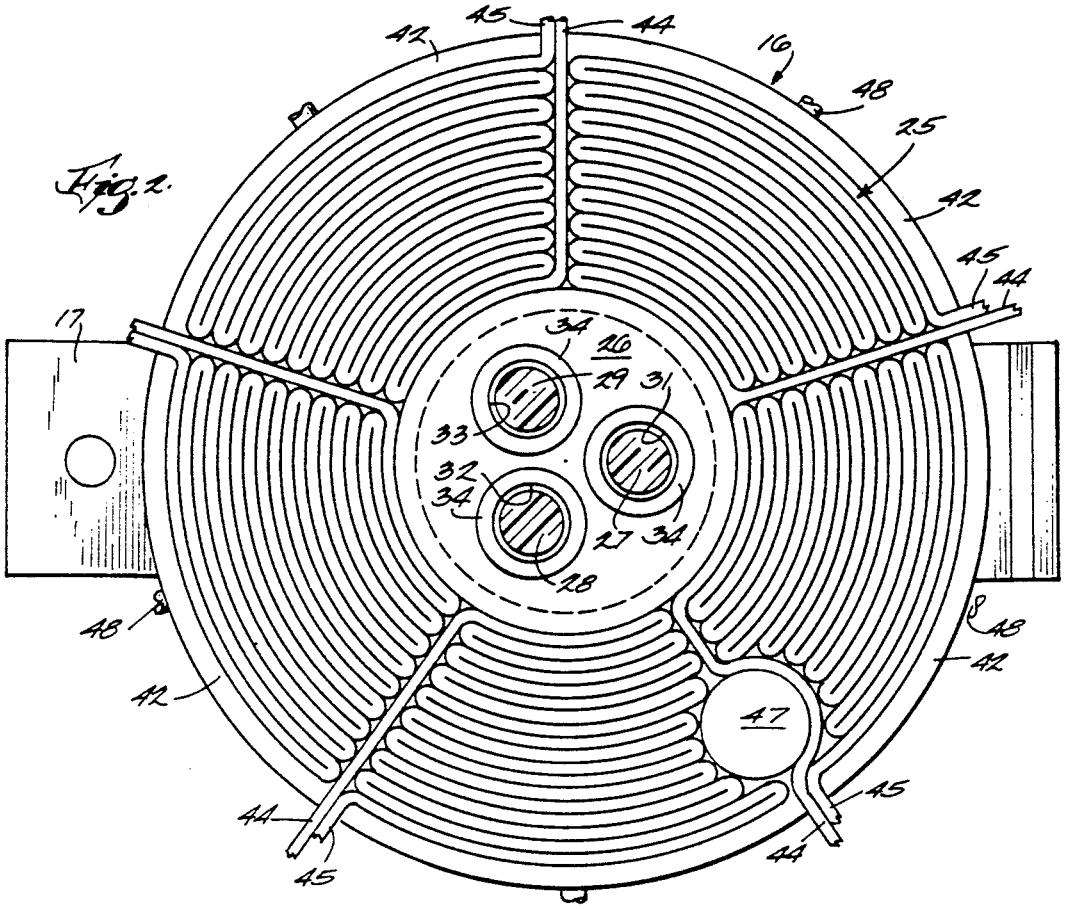
FIG. 2 is a top plan view of the electric arc furnace shown in FIG. 1.

The electric arc furnace 10, according to the invention, includes a dished hearth 12, a lower side wall 13, a generally cylindrical upper side wall 14 and a generally circular roof 16. The hearth 12 and the lower side wall 14 are formed of a suitable refractory material which is well-known in the art. At one end of the hearth there is a pouring box 17 having a tap hole 18 in its lower end. During a melting operation, the tap hole 18 is closed by a refractory plug 19.

The upper side wall 14 may comprise water-cooled panels 20 to permit more efficient operation and to prolong furnace life. In the illustrated embodiment, the panels 20 are shown to include an inner metallic wall 21 cooled by spray nozzles 22. However, those skilled in the art will appreciate that the panels 20 may take any conventional form, since the details thereof form no part of the present invention. In any event, the upper ends of the panels 20 define a circular rim 23 at the upper margin of the side wall portion 14.

The roof 16 includes a cylindrical skirt portion 24 located at the upper end of the upper wall section 14 and forming an extension thereof. In particular, the lower margin of the skirt portion is complementary to and abuts the circular rim 23 of the wall section 14. Also forming a part of the roof is an annular section 25 whose outer periphery is complementary to the upper end of the skirt portion 24. Disposed within the annular section 25 is a central section 26 having a circular outer periphery which is complementary to and abuts the edge of the opening defined by the annular section 25.

Those skilled in the art will appreciate that the number of electrodes in any particular furnace is determined by the metallurgical process to be performed and the nature of the energy source. In the illustrated embodiment, three-phase power is employed so that there are three electrodes 27, 28 and 29. The electrodes 27, 28 and 29 extend vertically through suitable openings 31, 32 and 33 formed equilaterally around the axis of the central section 26 and defined by refractory collars 34. A water-cooled ring 36 may surround center section 26 and defines the inner periphery of the annular section 25.

As those skilled in the art will also appreciate, each electrode 27, 28 and 29 is suitably supported by a clamp, not shown, which is a part of an electrode support and positioning assembly, and which is also not shown but is well-known in the art. The electrode support and positioning assembly moves the electrodes 27, 28 and 29 relative to the furnace charge 35 so as to maintain the desired arc length. However, the general direction of electrode movement is normally downwardly as their lower ends are consumed or broken away. The electrode clamps not only support the electrodes, but also normally provide energizing current thereto.

Figure 1:
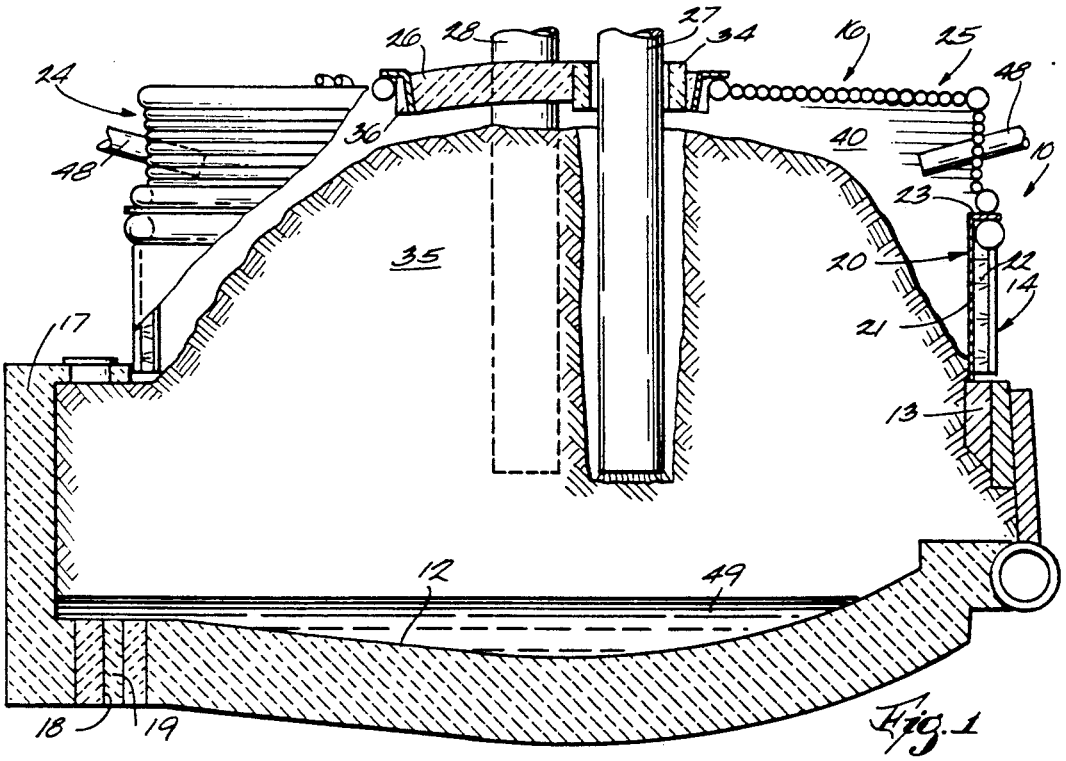
FIG. 1 is a side elevational view, partly in section, showing the electric arc furnace according to the preferred embodiment of the invention.

In the preferred embodiment of the invention, the annular roof section 25 is generally planar as shown in FIG. 1, although it may be slightly dished. The outer periphery of the roof section 25 is complementary to the upper edge of the cylindrical skirt section 24 and is substantially perpendicular thereto. Electrical arc furnace charge is normally scrap and when fed into the furnace forms a mound having a peak below the center section 26 and sloping downwardly and outwardly toward the side wall 14. This provides an annular space 40 between the roof 16 and the charge 35. As a result of the shape of the roof and the mound of furnace charge, the space 40 is deeper at its outer periphery and below the annular section 25 than at the central portion of the furnace below the circular section 26.

In the illustrated embodiment, the annular roof section 24 is shown to comprise a plurality of segments 42, each of which may be formed of tubing arranged in a serpentine pattern extending from side to side and each of which has an inlet pipe 44 and an outlet pipe 45. While the roof in the illustrated embodiment is formed of water-cooled tubing, the roof may also be formed of water-cooled panels, spray-cooled panels, or refractory without deviating from the invention. The roof 16 may also be formed with a port 47 for coupling the interior of the furnace to a gas cleaning system, not shown.

The skirt portion 24 of the roof 16 may also have any conventional form, such as water-cooled panels formed of tubing. Ports may also be formed in the skirt portion 24 for receiving burner nozzles 48.

The furnace 10 may be charged in any conventional manner. For example, the roof 16 and the electrodes 27, 28 and 29 may be elevated and swung away from the hearth 12 and the side walls 13 and 14, after which the charge 35 may be fed into the furnace by means of a charging bucket or the like. After charging has been completed and the roof 16 and the electrodes 27, 28 and 29 are repositioned, furnace operation can commence. During a furnace melting operation, the electrodes 27, 28 and 29 are lowered through the openings 31, 32 and 33 until the lower ends of the electrodes are in close proximity to the upper surface of the charge 35. After the electrodes have been positioned, they are energized so that an arc forms between their lower ends and the surface of the charge. During this initial stage, a substantial proportion of the heat is directed backwardly toward the furnace roof. As a result, power levels are maintained at a relatively low level to minimize damage to the furnace. As the scrap metal melts, the electrodes 27, 28 and 29 begin boring into the furnace charge, as shown in FIG. 1. At this point, the furnace power supply is switched to a relatively high level, forming relatively long arcs which pass through the charge 35 to the molten metal pool 49 collecting in the hearth 12.

During this meltdown period, heat for melting the charge 35 is provided by radiation from the molten metal pool and the arc, and the resistance offered by the scrap to the arc current as it flows to the grounded pool 49. Depending upon the constituents of furnace charge, oxidation of elements, such as carbon, manganese, silicon, phosphorous and other elements occurs while the charge 35 is being melted. The oxygen for these reactions may be obtained from a variety of sources, such as oxygen injection into the bath, oxygen present in the furnace atmosphere, oxygen present in alloying elements which may be added to the furnace, and oxygen from ore or the calcination of limestone, if the latter are employed. These reactions and the melting process itself generate substantial quantities of dust, fumes and waste gases.

In prior art arc furnace operation, hot waste gases, dust and fumes were removed through the vent opening 47 in the roof for filtering in a gas-cleaning system before discharge into the atmosphere. The space 40 created around the upper surface of the charge in the arc furnace 10 according to the present invention, permits these gases to expand and oxidize. This substantially reduces the level of CO in the waste gases exiting the furnace so that a reduction in the size and, hence, the capitol and operating costs of emission control equipment may be achieved.

Once the electrodes in prior art furnaces have bored into the charge, heating of the charge occurs principally from below as a result of radiation from the molten metal pool and heat generated by the arc. The configuration of the roof 16 promotes oxidation of CO in the space 40 so that additional heat is transferred from the combustion gases to the charge 35 from above. This results in more efficient energy recovery from the gaseous discharge products and also provides the space necessary for reactions which promote more complete combustion, thereby reducing the CO level. The transfer of heat from the discharge gases to the charge 35 also reduces the loading on energy removal devices downstream of the furnace and the amount of cooling water required for ductwork which conveys the gases away from the furnace 10.

Another advantage of the space 40 is improved communication between the vent opening 47 and other openings in the furnace. This creates a slight in draft at these openings through which polluting dust and gases might otherwise escape. Such other openings include the electrode openings 31, 32 and 33, ports for the burners 48, gaps between the roof 16 and the furnace side wall 15 and the like. As a result, ventilation control of electrode ports and other openings is substantially improved. There is also improved coupling with sensors mandated by clean air regulations and process pressure tracking and system regulation are improved.

The furnace configuration which provides the space 40 also results in cooler electrodes and conserves graphite by locating combustion away from the electrodes, while improved ventilation protects electrode holders. As a result, spray cooling of the electrodes or water-cooled electrodes are not required. Finally, the configuration of the furnace according to the invention results in reduced charging time by eliminating interference between the roof and the charge burden so that bucket crushing of the charge is minimized.

While only a single embodiment of the invention has been illustrated and described, it is not intended to be limited thereby, but only by the scope of the appended claims.

Figure 3:
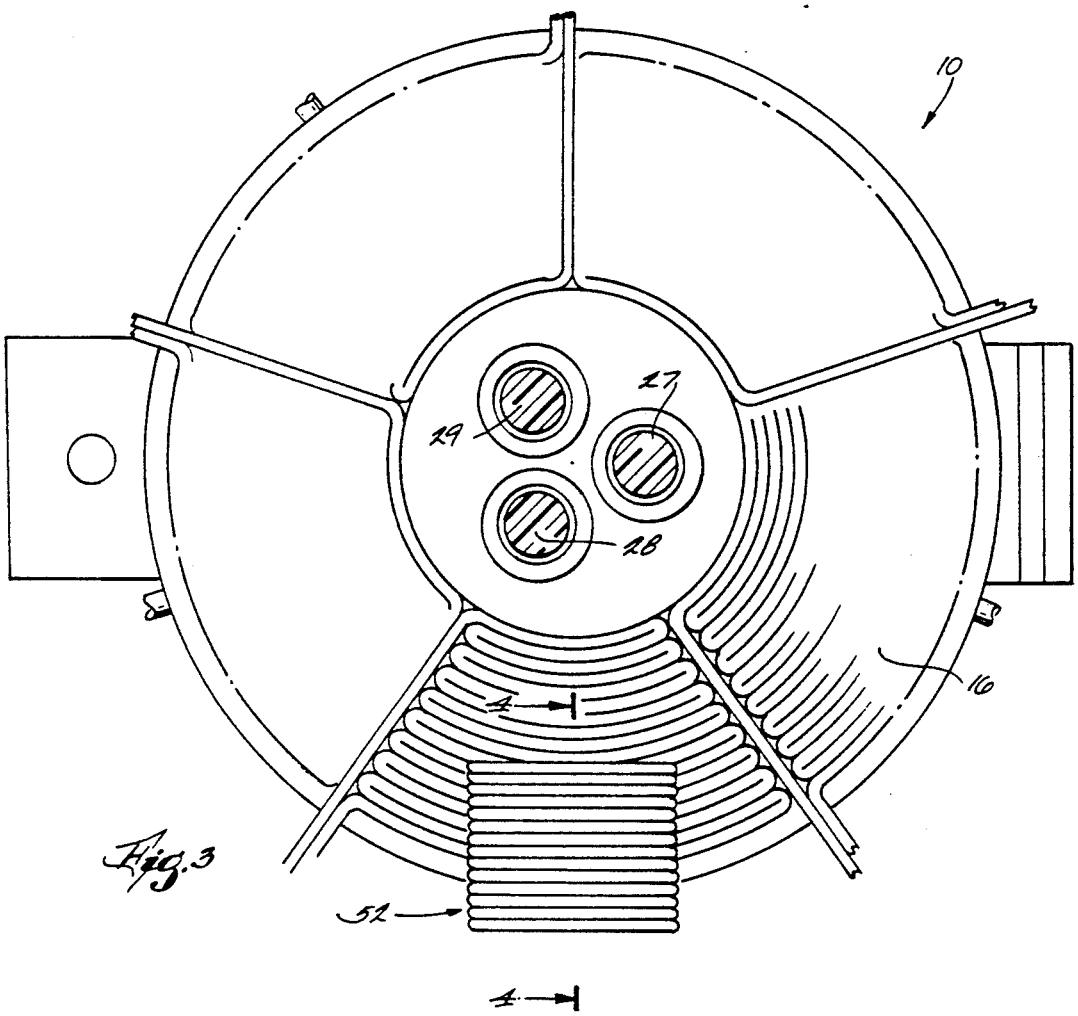
FIGS. 3 and 4 show an alternate embodiment of the invention.
Figure 4:
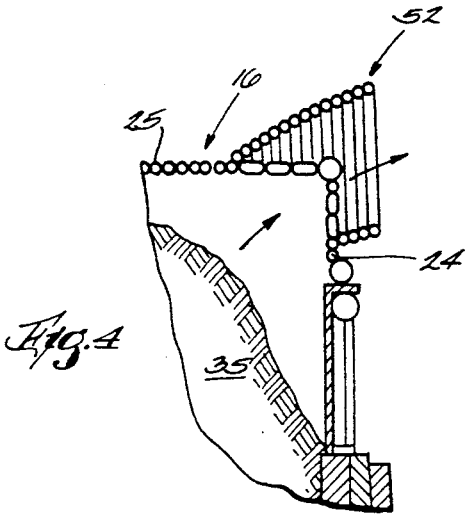

FIGS. 3 and 4 show an alternate embodiment of the invention to include a water-cooled take-off conduit 52 integral with the roof 16 and communicating with an opening 54 formed at the intersection of the skirt portion 24 and the annular section 25. The take-off conduit 52 results in lower take-off velocities so that less fluxing and chemical reaction materials are pulled from the furnace 10. This reduces the amount of carbon and lime required per ton of steel produced, thereby reducing production costs.

The position of the opening 54 which opens into both the skirt 24 and the top portion of the roof 16 results in a larger cross-sectional take-off area. This permits a greater degree of control of oxygen indraft so that preferential combustion of CO will occur, thereby minimizing the formation of NOx.

I claim:

1. An electric arc furnace including a hearth for receiving a solid furnace charge and for containing molten metal resulting from the melting of the charge, a side wall extending upwardly from said hearth and having an upper rim and a roof extending over said side wall and abutting the upper rim thereof, at least one electrode extending through an electrode opening formed in said roof for heating a charge in said furnace wherein heated waste gases and CO are generated, said furnace being configured so that a solid furnace charge in said furnace defines a mound having a peak and a surface which slopes downwardly and outwardly therefrom, said roof having a central portion disposed generally above the peak an outer peripheral portion surrounding the central portion, and a generally cylindrical skirt portion extending downwardly from an outer edge of the peripheral portion at least said outer peripheral portion being generally planar, the roof being configured so that the sloping surface of the mound diverges from the roof as the roof and mound extend outwardly toward the side wall of the furnace to define a space above and around the upper surface of the mound for promoting the transfer of heat to the furnace charge from the heated waste gases and the combustion of CO in said space, a vent opening formed at an intersection of said outer peripheral and skirt portions of said roof and opening into said space for communicating with said electrode opening and the abutment between said roof and the upper rim of the sidewall.

2. The arc furnace set forth in claim 1 wherein the outer peripheral portion of the roof and the skirt portion are water-cooled.

3. An electric arc furnace including a hearth for receiving a solid furnace charge and for containing molten metal resulting from the melting of the charge, a generally vertical side wall extending upwardly from and around said hearth and having an upper rim, a roof extending over said side wall, at least one electrode extending through an electrode opening formed in said roof and into the interior of said furnace, said roof having a central portion, a generally planar outer peripheral portion extending generally horizontally and perpendicularly relative to said side wall, and a cylindrical skirt portion extending downwardly from the peripheral portion and abutting the upper rim of the side wall, a vent opening formed at the intersection of the peripheral and skirt portions of said roof, and conduit means coupled to said vent opening and extending upwardly and outwardly therefrom.

* * * * *